US006577233B2

(12) United States Patent
Suzuki et al.

(10) Patent No.: US 6,577,233 B2
(45) Date of Patent: Jun. 10, 2003

(54) FIRE ALARM SYSTEM AND TERMINAL EQUIPMENT IN THE SAME

(75) Inventors: Takashi Suzuki, Tokyo (JP); Takao Fujisawa, Tokyo (JP); Yuki Yoshikawa, Tokyo (JP); Kenth Sandell, Göteborg (SE)

(73) Assignee: Nittan Company Limited, Tokyo (JP)

( * ) Notice: Subject to any disclaimer, the term of this patent is extended or adjusted under 35 U.S.C. 154(b) by 0 days.

(21) Appl. No.: 09/939,618

(22) Filed: Aug. 28, 2001

(65) Prior Publication Data

US 2002/0024436 A1 Feb. 28, 2002

(30) Foreign Application Priority Data

Aug. 30, 2000 (JP) ..... 2000-261380

(51) Int. Cl.[7] ..... G08B 29/00

(52) U.S. Cl. ..... 340/506; 340/511; 340/514; 340/533; 340/3.1

(58) Field of Search ..... 340/506, 505, 340/511, 514, 517, 533, 3.1

(56) References Cited

U.S. PATENT DOCUMENTS

| | | | | | |
|---|---|---|---|---|---|
| 4,300,099 | A | * | 11/1981 | Maruyama | 328/6 |
| 4,988,988 | A | * | 1/1991 | Kimura | 340/3.44 |
| 5,183,714 | A | * | 2/1993 | Mitsui et al. | 429/123 |
| 5,349,644 | A | * | 9/1994 | Massey et al. | 706/10 |
| 5,400,246 | A | * | 3/1995 | Wilson et al. | 700/17 |
| 6,020,811 | A | * | 2/2000 | Saito et al. | 340/438 |
| 6,144,993 | A | * | 11/2000 | Fukunaga et al. | 709/208 |
| 6,173,334 | B1 | * | 1/2001 | Matsuzaki et al. | 709/245 |
| 6,239,697 | B1 | * | 5/2001 | Murao | 340/506 |
| 6,243,018 | B1 | * | 6/2001 | Saito et al. | 340/650 |

* cited by examiner

*Primary Examiner*—Daryl Pope
(74) *Attorney, Agent, or Firm*—Stevens, Davis, Miller & Mosher, LLP

(57) ABSTRACT

In a fire alarm system, a plurality of terminal equipments are connected to a control panel. The terminal equipments include a first terminal equipment provided with a first mode in which the first terminal equipment is controlled by the control panel, and a second mode in which the first terminal equipment controls a second terminal equipment which is other than the first terminal equipment.

7 Claims, 5 Drawing Sheets

FIG. 3

| MEMORY ADDRESS | CONTENTS |
|---|---|
| 0x00 | REPLY ADDRESS |
| ..... | ..... |
| 0x0A | STATUS REGISTER |
| 0x0B | ANALOG INTERRUPT THRESHOLD VALUE |
| 0x0C | DIGITAL OUTPUT CONTROL REQUIREMENTS |
| 0x0D | START ADDRESS |
| 0x0E | STOP ADDRESS |

FIG. 4

| MEMORY ADDRESS | CONTENTS |
|---|---|
| 0x01 | REPLY ADDRESS |
| ..... | ..... |
| 0x0D | START ADDRESS |
| 0x0E | STOP ADDRESS |
| 0x0F | CONTROLLED OBJECT |
| 0x10 | OUTPUT MODE |
| 0x11 | OUTPUT PATTERN |
| 0x12 | PULSE WIDTH |

FIRE ALARM SYSTEM AND TERMINAL EQUIPMENT IN THE SAME

BACKGROUND OF THE INVENTION

The present invention relates to a fire alarm system including: a plurality of terminal equipments disposed in individual sections within a monitored area, and a control panel for monitoring or controlling the terminal equipments, as well as to a terminal equipment to be disposed within the monitored area.

A fire alarm system to be installed in a building comprises terminal equipments to be disposed in individual sections within a monitored area, such as a fire alarm sensor and a smoke control system, and a control panel which is to be disposed in a disaster prevention center and controls the terminal equipments. A predetermined command signal and a data signal are exchanged between the control panel and the terminal equipments, thereby performing emergency disaster prevention.

In such a fire alarm system, the control panel performs centralized control operation while collecting signals from many terminal equipments. Hence, the fire alarm system yields an advantage of the ability to detect a fire with higher reliability than could be achieved by individual terminal equipments.

However, in the event that the control panel is in trouble or a transmission line between the control panel and the terminal equipments is broken, there arises a risk of the terminal equipments being uncontrolled and unable to detect a fire.

When a terminal equipment is activated by the control panel; for example, when a fire door is actuated, a solenoid is brought into conduction. The control panel must perform a control operation for initially sending a signal to turn on the solenoid and sending another signal to turn off the solenoid. Correspondingly, the control panel must perform a complicated control operation. Further, in the event that the control panel is in trouble, a fire door becomes impossible to actuate, As mentioned above, in the related fire alarm system, the majority of control operations are dependent on the control panel. Hence, in the event that a problem has occurred in the control panel or a line to the control panel, the entire fire alarm system would not work.

SUMMARY OF THE INVENTION

It is therefore an object of the present invention to provide a fire alarm system even when the control panel cannot control terminal equipments, or even when the control panel has low processing capability.

In order to achieve the above object, according to the present invention, there is provided a fire alarm system, comprising:

a plurality of terminal equipments; and a control panel, which monitors or controls the terminal equipments, wherein the terminal equipments include a first terminal equipment provided with a first mode in which the first terminal equipment is controlled by the control panel, and a second mode in which the first terminal equipment controls a second terminal equipment which is other than the first terminal equipment.

In this configuration, at least one of the terminal equipments has a control function of controlling another terminal equipment. Even in the event of a failure having occurred in the control panel or the control panel having become uncontrollable for reasons of a break in a line between the control panel and the terminal equipment, the terminal equipment having the control function can control another terminal equipment in lieu of the control panel, thereby ensuring the function of the overall fire alarm system.

Here the term "terminal equipments" encompasses various kinds of fire detectors, interface modules, gas sensors, smoke control systems, manual call points, and local alarm bells. Particularly, analog type fire detectors of various types, an interface module connected to an on/off type sensor, and a manual call point capable of manually recognizing a fire are preferable as terminal equipments to be provided with control functions. A control function is added to a terminal equipment capable of sensing a fire. In the event that a fire has occurred while a control panel is inoperative, alarming activity can be carried out.

A terminal equipment having a control function may be controlled by another terminal equipment having a control function, Preferably, the first terminal equipment is provided with a memory for registering the second terminal equipment.

Alternatively, the second terminal equipment may be provided with a memory for registering the first terminal equipment.

In the above configurations, a control-controlled link relationship can be set between terminal equipments. In short, when the first terminal equipment sends a control signal to the second controlled terminal equipment stored in the memory, or when a the second terminal equipment receives a control signal, the second terminal equipment responds if the signal is output from the first terminal equipment stored in the memory.

Memory in the first terminal equipment and memory in the second terminal equipment may store the address of a terminal equipment to be registered. Alternatively, the range of a specific address is stored, and terminal equipments having addresses falling within the range may be taken as objects to be registered. Still alternatively, in the case of the first terminal equipment, there is stored a specific group; for example, terminal equipments of a specific type such as fire doors or terminal equipments disposed in a specific area such as on the first floor so that terminal equipments belonging to the group are registered as terminal equipments to be controlled Preferably, the second terminal equipment is provided with a first mode in which the second terminal equipment is controlled by the control panel, a second mode in which the second terminal equipment is controlled by the first terminal equipment and a third mode in which the second terminal equipment does not reply to the first terminal equipment's control.

In this configuration, in a case where all the terminal equipments located on one floor or all the terminal equipments of a single type are taken as a group unit, and where a control signal is sent to the group unit as an object of control, terminal equipments which do not require such control can be set so as not to respond. Eventually, terminal equipments to be controlled can be set individually.

Preferably, the first terminal equipment is a fire detector, which transmits a detected result to the control panel in response to an instruction issued from the control panel. Here, the fire detector transmits a fire signal to the control panel when a fire is detected, regardless of the issuance of the instruction.

In this configuration, even when no instruction is issued from the control panel, the fire detector transmits the fire signal to the control panel. Consequently, even when a fire detector that has detected a fire is not in communication with the control panel, the fire detector causes an interrupt in the event of occurrence of a fire, thereby sending a fire signal and ensuring a fire alarming activity without failure.

Here, it is preferable that the fire detector selects the second mode when the control panel does not reply to the fire signal.

In this configuration, when the fire detector does not receive any response from the control panel despite having sent the fire signal, the fire detector performs a control operation (second mode) on its own initiative. Hence, even when fire alarming activities centered on the control panel are not carried out, the fire detector that has detected a fire can carry out the fire alarming activity, thereby ensuring the function of the fire alarm system.

According to the present invention, there is also provided a terminal equipment in a fire alarm system, comprising a memory which stores a pattern of a predetermined output signal according to the output object.

In this configuration, since the terminal equipment stores the pattern of the predetermined output signal according to the output object in the memory, even if a control signal output from the control panel is simple, the terminal equipment can output an appropriate signal according to the output object.

Here, the output object may be the terminal equipment described previously, or others. The output signal may be outputted directly or indirectly to the output object. Specifically, if an interface module connected to a fire door is the above terminal equipment, an output signal pattern for driving the fire door may be stored in the interface module. Alternatively, if a fire door is the above terminal equipment, an output signal pattern for driving itself may be stored in the fire door. Further, if the terminal equipment is a fire detector, a display light of the fire detector may be illuminated in accordance with an output signal pattern stored in a memory of the fire detector.

The followings are conceivable as the pattern of an appropriate output signal according to the output object. In the case where the pattern is for driving a fire door, the pattern of a one-shot pulse signal is desirable. In the case where the terminal equipment is a local alarm bell or a display lamp, the pattern of a cyclic pulse signal is desirable.

This terminal equipment may be the above described terminal equipment which is able to control another terminal equipment, the above described terminal equipment to be controlled, or a terminal equipment having both functions.

Generally speaking, according to the present invention, autonomy of the terminal equipment is improved. Hence, in the event of the control panel being uncontrollable, the function of the fire alarm system can be ensured.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein:

FIG. 3 is a table showing example data stored in an EEPROM of a smoke detector;

FIG. 4 is a table showing example data stored in an EEPROM of an interface module;

DETAILED DESCRIPTION OF THE PREFERRED EMBODIMENTS

One embodiment of the present invention will be described below in detail with reference to the accompanying drawings.

Figure 1:
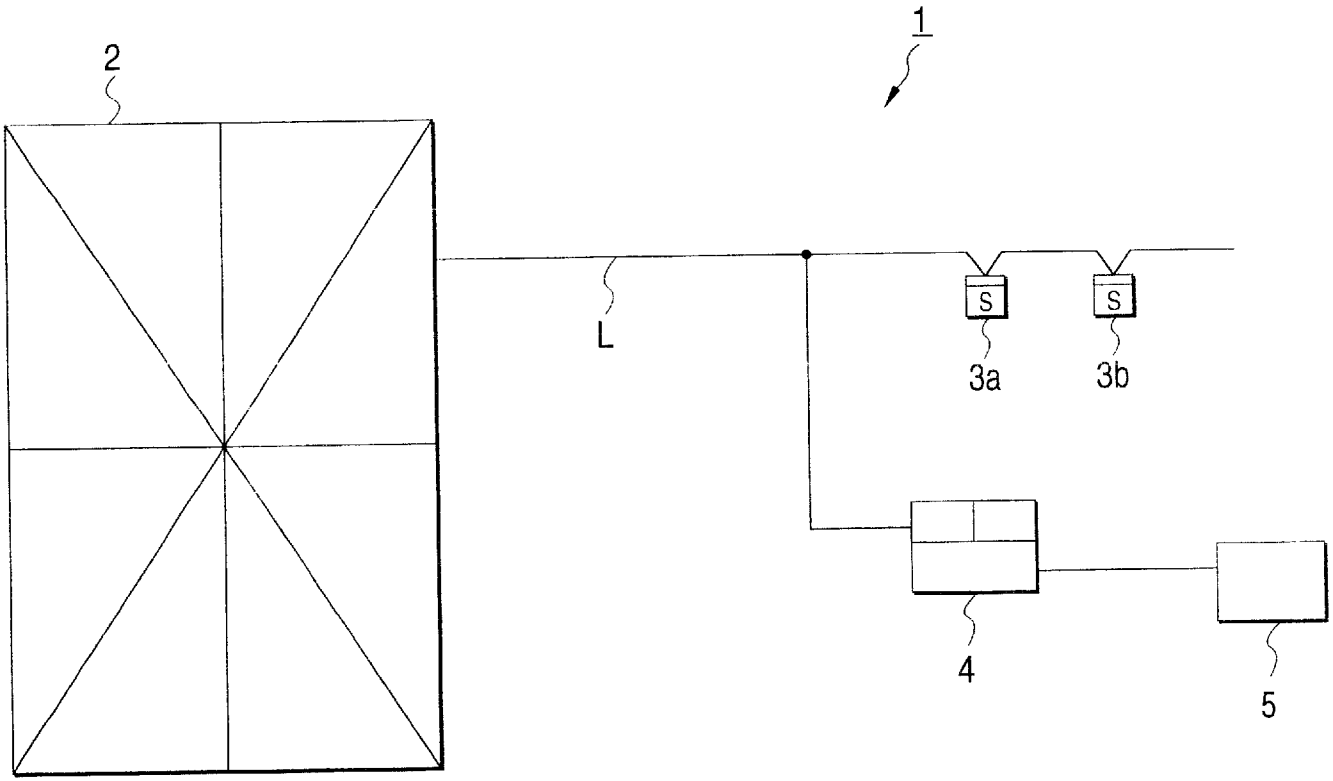
FIG. 1 is a schematic block diagram showing of a fire alarm system according to one embodiment of the invention.

In FIG. 1, a fire alarm system 1 is installed in a building and performs disaster prevention, such as monitoring for fires and issuing of an alarm. The fire alarm system 1 primarily comprises a control panel 2 and terminal equipments connected to the control panel 2 by way of a line L. Smoke detectors 3*a* and 3*b,* an interface module 4, and a fire door 5 connected to the interface module 4 are illustrated as the terminal equipments. Each of the terminal equipments has its own unique reply address. The terminal equipments exchange signals therebetween by way of the line L and receive power supplied from the control panel 2. FIG. 1 shows only example terminal equipments disposed in one area of a building; however, in practice, a greater number of terminal equipments are connected to the control panel 2.

In the fire alarm system 1, commands and data are exchanged through polling communication in which the control panel 2 is taken as a master and respective terminal equipments are taken as slaves.

The control panel 2 is disposed in, for example a disaster prevention center or a building manager room, and controls and centralizes operation of the fire alarm system 1.

More specifically, the control panel 2 sends, to each of the terminal equipments, a command along with a signal for specifying a reply address of the terminal equipment. For example, the control panel 2 sends, to the smoke detectors 3*a* and 3*b,* a signal for instructing transmission of a result of fire detection. If the control panel 2 determines occurrence of a fire from a signal(s) returned from either or both of the smoke detectors 3*a* and 3*b,* the control panel 2 performs various disaster prevention. The control panel 2 is provided with link data pertaining to terminal equipments so that disaster prevention are performed in accordance with the link data. More specifically, the link data defines objects to be activated when one fire detector has detected a fire, such as an interface module and an acoustic equipment. Here, the smoke detectors 3*a* and 3*b* and the interface module 4 are stored as one group in the control panel 2. When the control panel 2 has determined occurrence of a fire upon receipt of a signal from one of the smoke detectors 3*a* and 3*b,* the control panel 2 sends a control signal to the interface module 4 for activating the fire door 5 in accordance with link data.

As mentioned above, the control panel 2 in principle communicates signals between each of the terminal equipments through polling communication. Even when receiving an interrupt signal from either of the smoke detectors 3*a* and 3*b,* the control panels 2 sends to the smoke detector 3*a* a message indicating receipt of an interrupt signal, thereby commencing disaster prevention.

Each of the smoke detectors 3*a* and 3*b* has an unillustrated light-emitting element and a light-receiving element. The quantity of light received by the light-receiving element, which quantity varies according to a smoke density, is collected as an analog voltage. In accordance with an instruction from the control panel 2, a result of detection is converted into a digital value, and the thus-converted digital value is transmitted. In the event of occurrence of a fire, the smoke detectors 3*a* and 3*b* sends a fire signal to the control panel 2 even though an instruction is not issued by the control panel 2. A unique reply address is assigned to each of the smoke detectors 3*a* and 3*b*. In other respects, the smoke detectors 3*a* and 3*b* are completely identical with each other. Hence, in the explanation that follows, the smoke detector is described by means of taking only the smoke detector 3*a* as an example.

The interface module 4 relays a signal output from the control panel 2, thereby controlling and activating the fire door 5.

Figure 2:
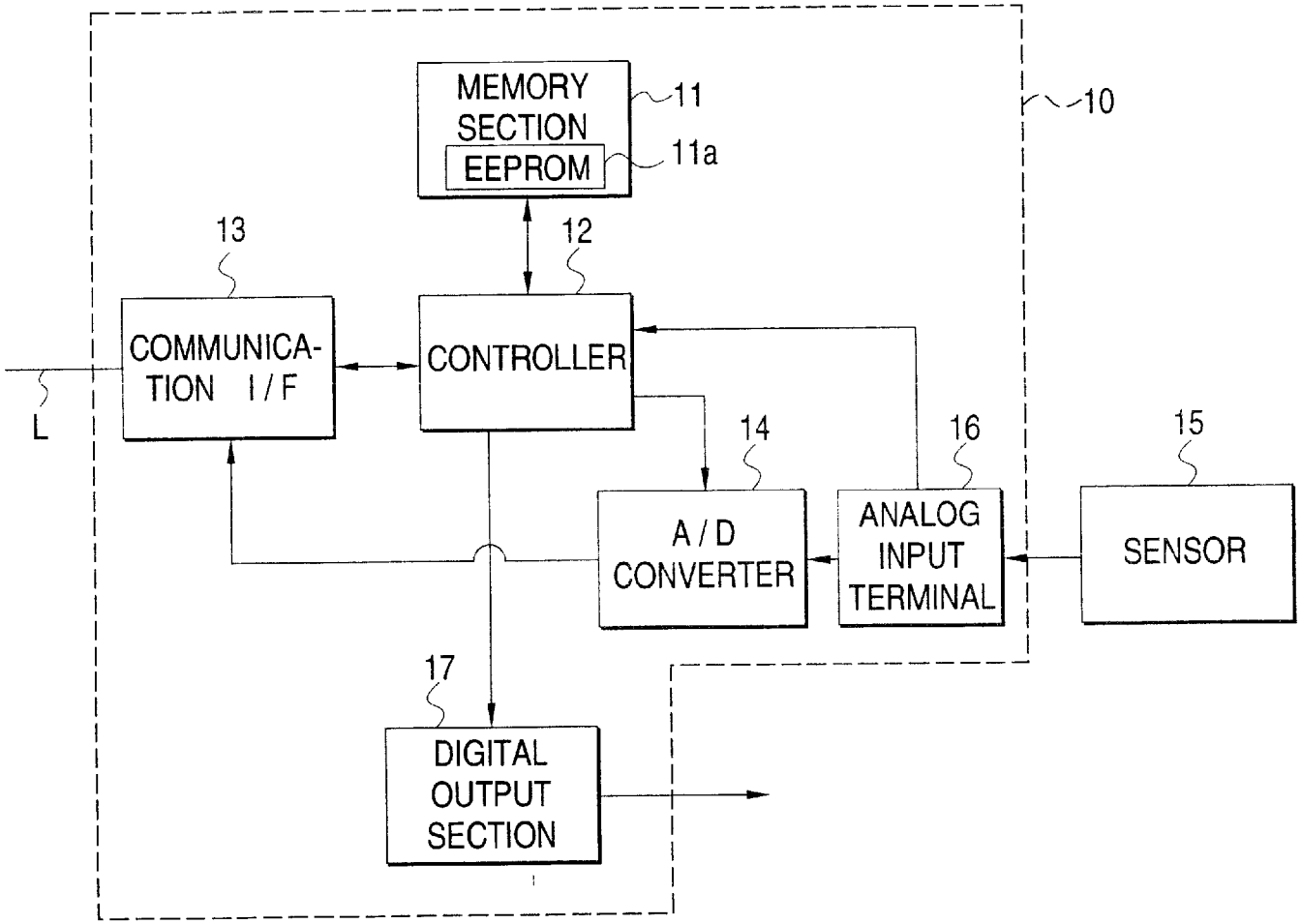
FIG. 2 is a schematic block diagram showing a control circuit in a terminal equipment shown in FIG. 1.

FIG. 2 shows the principal configuration of a control circuit 10 incorporated in the smoke detector 3*a* and the interface module 4. The control circuit 10 is constituted of, for example, a one-chip IC, and comprises a memory section 11, a controller 12, a communication interface 13, and a digital output section 17. The smoke detector 3*a* further comprises an analog-to-digital (A/D) converter 14 and an analog input terminal equipment 16 connected to a sensor (i.e., a light-receiving element) 15.

FIG. 2 shows a principally common configuration; each of the terminal equipments may further comprise other elements.

The communication interface 13 is connected to the line L and relays a signal to be exchanged with the control panel 2.

The controller 12 controls operation of the control circuit 10 in a centralized manner and identifies command information sent from the control panel 2 by way of the communication interface 13. In accordance with details of the command, the controller 12 sends a predetermined signal to the memory section 117 the A/D converter 14, and the digital output section 17.

The controller 12 of the smoke detector 3*a* determines occurrence of a fire if an analog value input to the analog input terminal equipment 16 from the sensor 15 has exceeded a predetermined threshold value to be described later, thereby sending a fire signal (interrupt signal) to the control panel 2 even though a request is not issued from the control panel 2. If no response is returned from the control panel 2 in spite of a fire signal having been sent to the control panel 2, the controller 12 individually commences a fire alarming operation, as will be described later Upon receipt of an instruction from the controller 12, the digital output section 17 provided in the smoke detector 3*a* illuminates a display lamp and the digital output section 17 provided in the interface module 4 outputs a digital control signal, to thereby activate the fire door 5.

Upon receipt of a signal conversion instruction from the controller 12, the A/D converter 14 provided in the smoke detector 3*a* converts an analog signal detected by the sensor (light-receiving element) 15 into a digital signal and outputs the thus-converted digital signal to the control panel 2.

The memory section 11 stores various data sets required for terminal equipment operations. The memory section 11 is constituted of an EEPROM (Electrically Erasable and Programmable Read Only Memory) 11*a* which enables erasure and writing of data, and RAM (Random Access Memory; not shown) for temporarily storing a reply address and a command. Upon receipt of a request signal from the controller 12, the memory section 11 outputs data stored therein. The controller 12 operates in accordance with various data sets stored in the EEPROM 11*a*.

The EEPROM 11*a* has a capacity of 128×8-bits and one address is assigned to every 8 bits (i.e., one byte) thereof Hereinafter, the addresses may also be called memory addresses.

Specific contents written in the EEPROM 11*a* are different according to the type of a terminal equipment. Characteristic contents of the EEPROM 11*a* in the smoke detector 3*a* will be described with reference to FIG. 3. Moreover, characteristic contents of the EEPROM 11*a* in the interface module 4 will be described with reference to FIG. 4.

First, contents stored in the EEPROM 11*a* in the smoke detector 3*a* will now be described with reference to FIG. 3. A reply address unique to the smoke detector 3*a* is written into a memory address "0×01" in the EEPROM 11*a* in the smoke detector 3*a*.

Further, conditions pertaining to generation of the interrupt signal are set in a memory address "0×0A." as a status register. An analog interrupt threshold value is stored in a memory address "0×0B." The controller 12 compares the "threshold value" with the analog value entered from the sensor 15 by way of an analog input terminal equipment 16. If the analog value is to lower than the "threshold value," the controller 12 determines that no fire has occurred. In contrast, if the analog value is higher than the "threshold value," the controller 12 determines that a fire has occurred. When having determined that a fire has occurred, the controller 12 outputs an interrupt signal in accordance with the conditions set in the status register.

The status register consists of eight bits. For instance, so long as an interrupt enable bit at bit 3 is set to "1," transmission of an interrupt signal is enabled. In contrast, if the interrupt enable bit is set to "0," transmission of an interrupt signal is not performed.

A timing at which an interrupt signal is to be transmitted can be filtered by the status register. For example, in a case where bit 5 of the status register is set to "1," when a measured analog value exceeding a threshold value is obtained, the status register transmits an interrupt signal after having ascertained a measured analog value 15 times. In a case where bit 6 is set to "1," the status register transmits an interrupt signal after having ascertained the analog signal once. If both bits 5 and 6 are set to "1" or "0," the status register immediately transmits an interrupt signal without involving an ascertaining operation when a measured analog value has exceeded a threshold value. In the present embodiment, the status register is set so as to perform an ascertaining operation "15" times.

Further, requirements for digital output control are stored in a memory address "0×0C." Here, a digital output control operation will now be described The smoke detector 3*a* according to the present invention performs only a fire detecting operation under control of the control panel 2. However, in the event that, because of a trouble in the control panel 2 or a break in the line L, no response is sent back from the control panel even when the smoke detector 3*a* has transmitted an interrupt signal, the smoke detector 3*a* per se controls a digital output from another terminal equipment, instead of the control panel.

As the requirements for digital output control stored in the memory address "0×0C," three requirements are set; that is, (1) an analog measured value has exceeded the threshold value, (2) 15 ascertaining operations set by the status register have been performed, and (3) 15 interrupts signals have been transmitted to the control panel 2 in accordance with the results of (1) and (2).

If these three requirements have been satisfied, a control signal is transmitted to a predetermined terminal equipment in accordance with link data defined by both a start address "0×0D" and a stop address "0×0E" A start address and a stop address define the range of a reply address, so that terminal equipments to be controlled are specified For example, if a start address is "0000001" and a stop address is "00000008," the range of a reply address is set to "00000001," "00000002," . . . "00000007," and "00000008"."Thus, eight terminal equipments are to be controlled. In the present embodiment, the start address and the stop address are so determined as to include the reply address of the interface module 4.

Data shown in FIG. 4 are written in the EEPROM 11*a* of the interface module 4 which is an object of digital control of the smoke detector 3*a*. A reply address of the interface module 4 is stored in a memory address "0×01."

In a memory address "0×0F," there is stored a controlled object, to which the interface module 4 outputs a digital signal in response to a control signal output from the control panel 2 or the smoke detector 3*a*. In the present embodiment, the "fire door 5" is stored in the memory address "0×0F," and hence the interface module 4 actuates the fire door 5 upon receipt of a control signal.

An output mode stored in "0×10", an output pattern stored in "0×11", and a pulse width stored in "0×12" are data for defining a drive signal to be output from the interface module 4. Each of the "output mode" and the "output pattern" is a one-bit data serving as a flag for defining a specific pattern of a drive signal. FIG. 5 shows example pattern of a drive signal generated in the interface module 4.

Figures 5A, 5B, 5C, 5D:
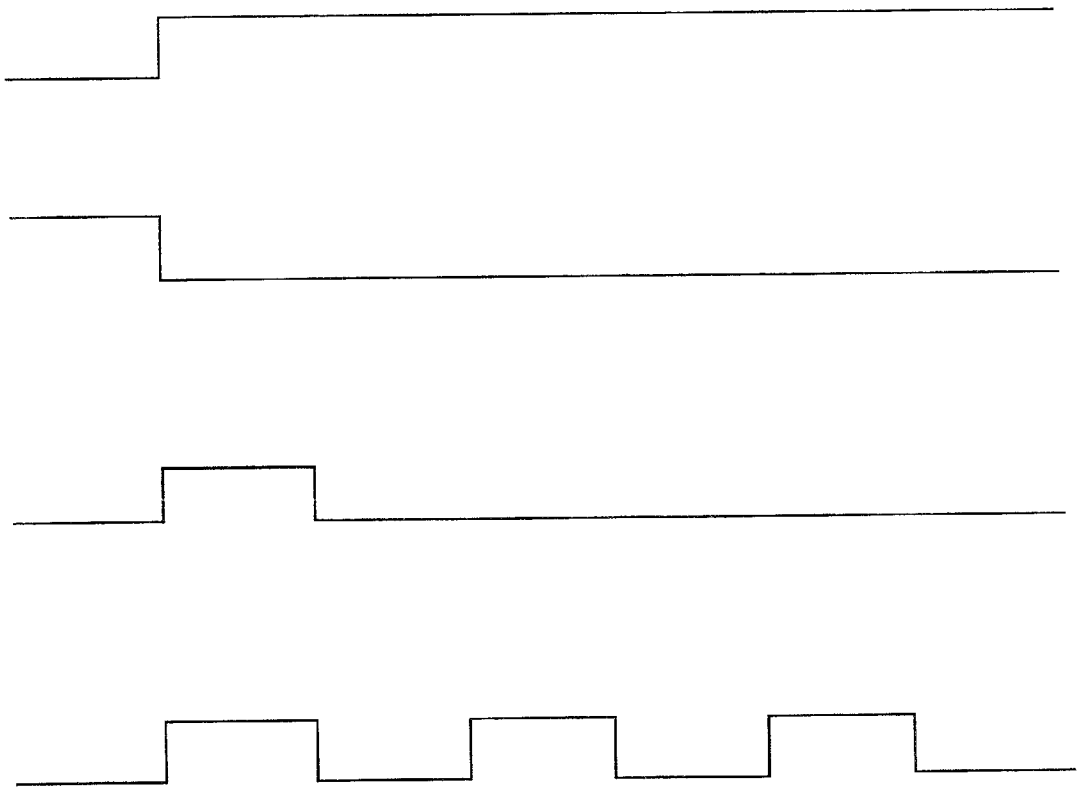
FIGS. 5A to 5D are diagrams showing patterns of output signals which are set in the interface module.

When "1" is set in the "output mode", a pattern of drive signal depends on a setting in the "output pattern", In a case where "0" is set as the "output mode," a drive signal having a constant value of a high level as shown in FIG. 5A or a low level as shown in FIG. 5B.

When "1" is set for the "output mode" and "0" is set for the "output pattern," there is generated a one-shot pulse signal having a length defined by a "pulse width," as shown in FIG. 5C. When the "output mode" and the "output pattern" are set to "1," there is generated a cyclic pulse signal having a cycle double the "pulse width" and a 50% duty ratio, as shown in FIG. 5D. In a case where a controlled object is the fire door 5, the one-shot pulse signal is used to obviate a necessity for sending a control signal twice as in the related art discussed the above. So long as the control panel 2 (or the smoke detector 3*a*) has once sent a control signal, the interface module 4 outputs a drive signal of pattern 3 in accordance with the data stored in the memory section thereof. The interface module 4 operates in the same manner as mentioned above, regardless of the origin of the control signal, that is, the control panel 2 or the smoke detector 3*a*.

When "0" is set in the "0×0D" start address of the interface module and "0" is set in the "0×0E" stop address of the same, the interface module 4 does not respond to a digital output from the smoke detector 3*a* even when the reply address of the interface module 4 falls within the range of control objects of the smoke detector 3*a*.

Data other than the data described in the tables shown in FIGS. 3 and 4 may be stored in the EEPROM 11*a* of the smoke detector 3*a* and that of the interface module 4.

Fire detecting operation to be performed by the controller 12 of the smoke detector 3*a* will now be described by reference to FIG. 6. Supposing a case where the "status register" of the smoke detector 3*a* (FIG. 3) is set in a state in which an interrupt signal is transmittable, and the "start address" and "stop address" of the interface module 4 are not set to "0."

Figure 6:
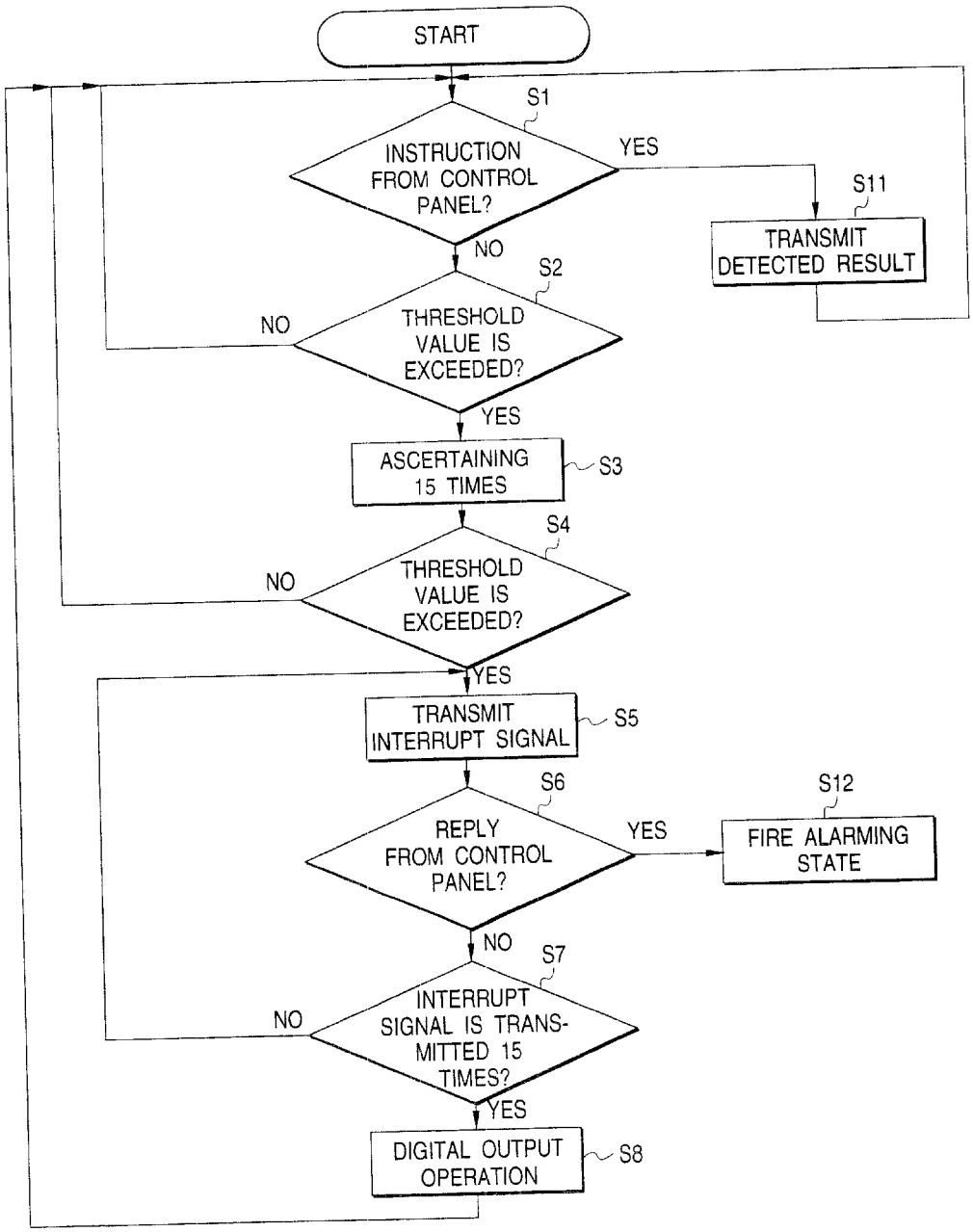
FIG. 6 is a flowchart showing fire detection processing to be performed by a controller of the smoke detector.

Flow shown in FIG. 6 starts from a normal monitoring state. In step S1, a determination is made as to whether or not there has been input from the control panel 2 a signal for instructing transmission of a result of detection of a measured analog value. If it is determined that there is an instruction, processing shifts to step S11. A digital value, into which the value detected by the sensor 15 (FIG. 2) has been converted through A/D conversion, is transmitted to the control panel 2. Processing again returns to step S1.

If in step S1 it is determined that no instruction is input from the control panel 2, processing proceeds to step S2, where a determination is made as to whether or not the analog value has exceeded an "analog interrupt threshold value." if the analog value has not exceeded the threshold value, processing returns to step S1. In contrast, if the analog value has exceeded the threshold value, processing proceeds to step S3. In step S3, there is performed processing for ascertaining the analog value 15 times. In step S4, a determination is made as to whether or not the analog value exceeds a threshold value even after the measured value has been ascertained 15 times. If it is determined that the analog value does not exceed the threshold value, processing returns to step S1. In contrast, if it is determined that the analog value exceeds the threshold value, in step S5 a fire signal is transmitted as an interrupt signal to the control panel 2.

In step S6, a determination is made as to whether or not a response has been sent back from the control panel 2 in response to the interrupt signal If a response has been received, processing proceeds to step S12, where the smoke detector 3*a* enters an ordinary alarming state. At this time, by means of a control signal output from the control panel 2, the interface module 4 transmits a one-shot pulse signal shown in FIG. 5C, thereby actuating the fire door 5. If in step S6 no response is output from the control panel 2, processing proceeds to step S7, where a determination is made as to whether or not an interrupt signal has been transmitted 15 times. If 15 times have not yet been achieved, processing again returns to step S5. An interrupt signal is again transmitted. If 15 times have been achieved, processing proceeds to step S8.

In step S8, the smoke detector 3*a* performs a digital output control operation, thereby transmitting a control signal to the interface module 4. In response, the interface module 4 transmits a one-shot pulse signal shown in FIG. 5C to the fire door 5, and processing returns to step S1.

As shown in FIG. 6, in the present fire alarm system, the smoke detector 3*a* transmits a fire signal to the control panel 2 without an instruction output from the control panel 2. Hence, even when the smoke detector 3*a* is out of communication with the control panel 2, detection of occurrence of a fire can be surely transmitted to the control panel 2 to enter an alarming state.

In a large-scale fire alarm system, about one to two minutes are required until polling communication returns to the point of origin because the polling communication must be conducted all the sensors connected to a control panel in order. If the fire alarm system depends solely on the polling communication, there is probability that a fire cannot be detected immediately. For this reason, permission of an interrupt signal enables immediate detection of a fire at all times.

If, in spite of the fire signal having been transmitted, the control panel 2 does not respond, the smoke detector 3*a* controls the interface module 4 in accordance with the data stored in the start address and stop address provided in the EEPROM 11*a*. Hence, in the event of a trouble in the control panel 2 or an uncontrollable state of the control panel 2 due to a break in the line L, the smoke detector 3*a* (3*b*) actuates the fire door 5 by way of the interface module 4 in lieu of the control panel 2, thereby ensuring the function of the fire alarm system 1.

So long as both of the start address and the stop address are set to "0," the interface module 4 can be set so as not to respond to the control signal output from the smoke detector 3*a*. In the smoke sensor 3, if the terminal equipments to be controlled is specified in the range of start address and stop address, a control signal will be transmitted to all the terminal equipments applicable to this range. However, if the control of the interface module 4 discussed the above is not necessary, the interface module 4 is set so as not to respond to a control signal. Eventually, whether to be controlled or not to be controlled is able to be individually determined with respect to the respective.

The interface module 4 stores an output signal pattern corresponding to a controlled object. So long as the control panel 2 has once transmitted a simple control signal, the interface module 4 can output an appropriate signal corresponding to the controlled object (here, the fire door 5), in accordance with the control signal. Consequently, the processing capability of the control panel 2 can be reduced, and by extension control of a terminal equipment, such as an interface module, becomes feasible.

As mentioned above, as a result of an improvement in the autonomy of terminal equipments in the fire alarm system 1, the fire alarm system 1 can ensure its function even when the control panel becomes unable to control the terminal equipments.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For instance, there has been described an example in which a smoke detector acts as a terminal equipment having control functions. There may be employed other sensors, such as a heat detector or a flame detector. A terminal equipment other than a detector may be provided with the control function.

Link data used when a terminal equipment controls another terminal equipment are not limited so as to include only the reply address. Terminal equipments to be controlled may be set randomly. Alternatively, controlled terminal equipments may be set on respective specific areas; for example, all the terminal equipments disposed on one floor may be set as a group. Further, controlled terminal equipments may be set according to type.

In the previous embodiment, a controlled terminal equipment is stored in the EEPROM 11*a* provided in the smoke detector having a control function. However, alternatively, the smoke detector having a control function may be stored in an EEPROM 11*a* provided in a controlled terminal equipment.

In other words, a terminal equipment transmitting a control signal is stored in the EEPROM 11*a* provided in an interface module which is a terminal equipment to be controlled. In this case, for example, a top address of a terminal equipment transmitting a control signal to be received is written as the start address shown in FIG. 4. Further, an end address of a terminal equipment transmitting a control signal to be received is written as the stop address in FIG. 4. The controlled terminal equipment may be configured so as to perform an operation indicated by the control signal when a control signal transmitted from any terminal equipment designated by the start address and the stop address.

What is claimed is:

1. A fire alarm system, comprising:

a plurality of terminal equipments including a first terminal equipment and a second terminal equipment, and a control panel, which monitors or controls the terminal equipments, wherein said system includes a first mode in which the first terminal equipment and the second terminal equipment are controlled in response to instructions from the control panel and a second mode in which the first terminal equipment controls the second terminal equipment independently of instructions from the control panel.

2. The fire alarm system as set forth in claim 1, wherein the first terminal equipment is provided with a memory for registering the second terminal equipment.

3. The fire alarm system as set forth in claim 1, wherein the second terminal equipment is provided with a memory for registering the first terminal equipment.

4. The fire alarm system as set forth in claim 1, wherein the second terminal equipment is provided with a first mode in which the second terminal equipment is controlled by the control panel, a second mode in which the second terminal equipment is controlled by the first terminal equipment and a third mode in which the second terminal equipment does not reply to the first terminal equipment's control.

5. The fire alarm system as set forth in claim 1, wherein the first terminal equipment is a fire detector, which transmits a detected result to the control panel in response to an instruction issued from the control panel; and wherein the fire detector transmits a fire signal to the control panel when a fire is detected, regardless of the issuance of the instruction.

6. The fire alarm system as set forth in claim 5, wherein the fire detector selects the second mode when the control panel does not reply to the fire signal.

7. A terminal equipment in a fire alarm system, comprising:

an interrupter, which transmits an interrupt signal to a control panel in said fire alarm system, and a memory which stores a pattern of a predetermined output signal according to an output object, said predetermined output signal including at least one of a one-shot pulse and a cyclic pulse signal, and said output object including a fire door, an alarm bell, or a display lamp, wherein said interrupter transmits said output signal to said output object when no reply is obtained from said control panel in response to said interrupt signal.

* * * * *